US006090273A

United States Patent [19]

Kovacs

[11] Patent Number: 6,090,273

[45] Date of Patent: Jul. 18, 2000

[54] PROCESS TO REMOVE ASH-FORMING CONTAMINANTS FROM WET USED OIL

[75] Inventor: Geza L. Kovacs, Baltimore, Md.

[73] Assignee: U.S. Filter Recovery Services (Mid-Altantic, Inc.), Baltimore, Md.

[21] Appl. No.: 08/984,077

[22] Filed: Dec. 3, 1997

Related U.S. Application Data

[60] Provisional application No. 60/032,344, Dec. 4, 1996.

[51] Int. Cl.[7] ..... C10M 175/00

[52] U.S. Cl. ..... 208/179; 208/184; 208/185; 208/187

[58] Field of Search ..... 208/179, 184, 208/185, 187

[56] References Cited

U.S. PATENT DOCUMENTS

| | | | |
|---|---|---|---|
| 1,622,278 | 3/1927 | Boyd | 208/179 |
| 1,778,831 | 10/1930 | Jones | 208/179 |
| 1,926,188 | 9/1933 | Ambler | 208/186 |
| 2,305,464 | 12/1942 | Ashworth | 208/179 |
| 2,319,599 | 5/1943 | Harris | 208/186 |
| 2,446,489 | 8/1948 | Schaafsma | 208/179 |
| 2,459,409 | 1/1949 | Bjornstjerna | 208/179 |
| 2,789,083 | 4/1957 | Hardy | 208/179 |
| 3,919,075 | 11/1975 | Parc et al. | 208/180 |
| 3,923,643 | 12/1975 | Lewis et al. | 208/179 |
| 3,954,602 | 5/1976 | Troesch et al. | 208/179 |
| 3,990,963 | 11/1976 | Audibert et al. | 208/179 |
| 4,029,569 | 6/1977 | Ivey | 208/180 |
| 4,033,859 | 7/1977 | Davidson et al. | 208/179 |
| 4,250,021 | 2/1981 | Salusiinszky | 208/181 |
| 4,411,790 | 10/1983 | Arode | 208/186 |
| 4,938,876 | 7/1990 | Oohsol | 210/708 |
| 4,948,493 | 8/1990 | Wilson | 208/179 |
| 5,141,628 | 8/1992 | Martin et al. | 208/186 |
| 5,453,765 | 9/1995 | West | 208/186 |

*Primary Examiner*—Helane Myers

*Attorney, Agent, or Firm*—Roylance, Abrams, Berdo & Goodman, L.L.P.

[57] ABSTRACT

Used lubricating oil containing unacceptable levels of moisture and ash-forming contaminants is dried and clarified by a process that includes flash drying, heat treating at a temperature within the range of 600°–700° F. for 2–5 hours, and cooling the heat treated oil. Optional internal recycle of the product from each of these steps can help enhance the clarification process.

21 Claims, 2 Drawing Sheets

PROCESS TO REMOVE ASH-FORMING CONTAMINANTS FROM WET USED OIL

This application claims benefit of Provisional Application No. 60/032,344 filed Dec. 4, 1996.

FIELD OF THE INVENTION

This invention relates to a method for processing wet used hydrocarbon oils that contain ash-forming components, to produce dry oil that has a reduced content of ash-forming components. In particular, the invention relates to a process for continuously removing moisture, ash-forming components and solids, including organo-metllic additives, carbon paricles, and metal particles, from wet used of In one embodiment the invention relates to a continuous process which provides integrated resource recovery and minimization of pollution. The invention particularly relates to a process that can be effective for the removal of vitually all ash-forming materials that are found in used hydrocarbon oils, to generate products of materially enhanced economic value. The term de-ashed is used herein to refer to processed oil having a reduced content of ash-forming components preferably ≦0.01% by weight of the processed oil.

BACKGROUND

The base oils for hydrocarbon lubricating oils are generally produced in refineries from distillates. These base oil streams are often produced in several steps, in plants that may use solvent extraction, solvent dewaxing, and hydrogen treatment. To be able to meet the demands of modem engines, particularly those of internal combustion engines, various additives are often incorporated in the base oil. Such additives include, for example, antioxidants, pour point depressants, viscosity index improvers, detergents, dispersants, and other additives.

In use lubricating oils are generally not consumed in the usual sense and, except for some loss, are recovered as used oils. In the case of motor oils, usually more than 60% of the original oil is recovered when the oil is changed. Oil changes are necessary because in use the oil is contaminated with unburned fuel, metal particles, carbon particles, tars, polymerized material and the like. Used oil also becomes contaminated, inter alia, by combustion products which are kept dispersed by the added dispersants. Used oil also on analysis has a high ash content, typically in the range of 1%–2% by weight of the oil, due to metals (mainly Ca, Ba, and Zn) which were added to the base oil as ingredients of additives.

Used lubricating oil also usually contains significant amounts of moisture. The water content of freshly dined used lubricating oil is usually less than 0.5%. However, the water content increases dramatically during collection as a rest of condensation, contamination, or both, for example. Typically, waste crankcase oil at collection centers contains about 7% water by volume.

More than one billion gallons of lubricating oil are used in the United States on a yearly basis, according to the National Oil Recycles Association. Substantial quantities of this oil are available for disposal, somehow, after use. Collection centers for used oil are available in most cities, to encourage the use of environmentally acceptable or beneficial disposal techniques. Even so, of all the used oil that is potentially available for recovery, about 25% is unaccounted for.

Only about 75% of the used oil generated in the United States is currently being reclaimed each year. Ideally, all of the used oil should be reclaimed in order to avoid the damage to the environment that is caused by improper disposal.

However, even reclaimed oil causes environmental concern because of its high content of ash forming materials. Reclaimed oil is now primarily used as a fuel by being blended with virgin fuel to meet stack emission standards. Based on an analyzed ash content of 1% by weight of the oil, each million gallons of reclaimed oil that is burned releases about 37 tons of ash into the air. Since there may be 800 million gallons or so of used oil per year, curtly, in the United States, use of the used oil as a fuel is not an attractive approach from an environmental standpoint.

After the ash-forming materials are removed by the present invention such oils become useful as non-polluting heating fuel, marine fuel diesel fuel, and petroleum refinery cracker feed. In the past, recovered used lube oil has not been useful to oil refineries.

So far as is known, the prior art does not teach a heat-treating-filtration process for wet used oil that yields a product that has an ash content as low as 0.01%, 0.001%, or even lower but such levels can be achieved by preferred embodiments of the process of the present invention.

SUMMARY OF THE INVENTION

The invention provides a process for dying and clarifying wet used oil to produce clean oils from which their scents have been so efficiently removed that the reclaimed oil (i.e., the product of process of the invention) not only is moisture free but also has an ash content that is <0.01% and in some embodiments is 0.001%, or even less. When wet used crankcase oil is reclaimed according to the present invention, it is possible to recover a reclaimed oil that on analysis is virtually free of ash-formers.

The ambient pressure process of the invention removes ashless particles and constituents as well as ash-forming particles and constituents from modem used oils, including particles of colloidal size.

The process comprises not only the prolonged heat treating of the dried used oil from an initial drying step, but can also comprise in a preferred embodiment, the recycling of a portion of the heat treated product, preferably after cooling it, to be mixed with the wet used oil that is supplied to the initial drying step. It is theorized that the step of recycling brings solids in the oil into contact with moisture in the wet used oil feed supply, and facilitates agglomeration or other particulate solids growth, with subsequent facilitation of solids separation from the oil.

In a preferred embodiment, the recycle portion of the heat-treated product combines with the wet used oil feed of the previous drying step. This recycling of the cooled, heat-treated oil allows part of the heat-treated oil to revisit a moist environment, and then revisit the high residence, heat-treating zone before being filtered. The result of this recycle treatment was unexpected. It came as a surprise that it was possible with preferred embodiments of the invention, to obtain a final oil product with an analyzed ash content well below 0.1% by weight of the processed oil, and routinely below 0.01%, that is useful as is. In some cases, it was possible to recover processed oil with an ash content below 0.001%.

Whenever an ash content is mentioned in this application as a percentage, it is based on the weight of the oil from which a representative sample has been taken for measurement of its content of ash formers. The term "ash content" is used in this application to refer to the amount in percent of those incombustible materials in the oil that remain after incineration of the oil.

The process of the invention can be used to effect almost any desired reduction in the ash-former content of its used oil feedstock. Any substantial reduction in the content of the ash-formers in reclaimed oil generally enhances the economic value and utility of the reclaimed oil. For example, reclaimed oil can be sold as #4 heating fuel if the ash content is less than 0.05%. Cracker feed, which has a high economic value, must have a low content of ash-formers, preferably less than 0.01%, and can routinely be produced from dirty, wet, used lube oil by the process of the present invention.

More particularly, the invention comprises a process for recovering dry clean oil (i.e., clarified, de-ashed, dried oil) from wet used oil comprising the steps of (a) supplying a heated used oil mix comprising a mixture of wet used oil and a recycle portion of the product of step (d) below to a drying zone wherein the temperature of the used oil mix in said zone is such that moisture in said mix flashes off and is withdrawn from said zone, and wherein the dried used oil can be drawn off, (b) transferring said dried used oil of step (a) to a heat treating and agitating zone wherein said dried used oil is maintained at a temperature of at least about 600° F., preferably at least 650° F. and kept in an agitated state;

(c) removing heat-treated oil from said heat-treating and agitating zone and cooling it;

(d) separating a portion of the cooled heat-treated oil as said recycle portion of step (a);

(e) mixing said recycle portion with the wet used oil supply to said drying zone, to comprise the wet used oil mix of step (a); and (f) separating solids from remaining cooled oil product of step (c) to produce clean dry oil for reuse, having a very low ash content.

The invention provides a method for the recovery of an essentially ashless, dried oil from used lubricating oil that contains water and other contaminants. The recovered oil is usable as fuel oil, diesel oil, fuel oil, or "cracker feed", depending on the extent to which the ash-formers have been removed.

In another embodiment, the process of the invention comprises a continuous process for recovering dry clean oil from wet used oil comprising the steps of (a) supplying a used oil mix comprising (i) wet used oil, (ii) a recycle portion of the product of step (f) below and (iii) a recirculating portion of the dried used oil output of this step (a) into a drying zone at a temperature of at least about 275° F., wherein the moisture in the used oil feed mix flashes off in sad drying zone and said dried used oil is withdrawn from said dying zone;

(b) separating a portion of said dry used oil from step (a) for use as said recirculating portion, then preheating the remaining dry oil of step (a) to a temperature of about 350° F. to about 450° F., preferably about 400° F.;

(c) transferring said preheated dry used oil to a heat-treating and agitating zone;

(d) agitating and flowing said preheated remaining dry used oil into successive areas of said heat-treating zone at a temperature of about 600° F.–700° F. for a residence time sufficient to permit particle accretion therein, usually at least 1 hour preferably for at least 2 hours, more preferably for at least 3–5 hours, and generally for up to about 4 hours;

(e) removing the heat-treated oil from said heat-treating zone;

(f) cooling the heat-treated oil of step (e) to preferably about 240° F. to 280° F.;

(g) filtering the product of step (f) through a filter cloth precoated with a layer of diatomaceous earth; and (h) covering a clean oil filtrate with an ash content of <0.01%.

In another embodiment, the invention comprises equipment for upgrading moisture- and ash-containing used oil comprising in combination (a) means for flash drying said wet used oil at an elevated temperature;

(b) means for heating said flash dried oil to a temperature of at least about 600° F. for a sufficient time to render particles in said oil, after cooling to a temperature in the range of about 200° F.–300° F., readily separable from the oil upon appropriate filtration of the oil;

(c) means for then cooling the oil to a temperature in the range of about 200° F.–300° F., and (d) separating means for separating particles from the oil to permit recovery of a clarified, de-ashed, dried oil.

In another embodiment, the invention provides a process for the recovery of an essentially ashless oil from used lubricating oil comprising the steps of (a) supplying heated used oil to a drying zone whereby the temperature of the used oil in said zone is such that moisture in said used oil flashes off and is withdrawn from said zone;

(b) mixing said dry used oil from step (a) with a recycle portion of the product of step (d) below and feeding the mix to a heat treating and agitating zone wherein said dry used oil mix is maintained at a temperature in the range of at least 600° F. and kept in an agitated state for a residence time that permits accretion of solid particles in said oil;

(c) removing heat-treated oil from said heat-treating and agitating zone and cooling it;

(d) separating a portion of said cooled heat-treated oil as said recycle portion of step (b);

(e) mixing said recycle portion with said dry used oil; and (f) filtering the remaining cooled product of step (c) to thereby separate out solids therein and produce clean dry oil for reuse.

DETAILS OF THE INVENTION

Except in the claims and in the operating Examples, or where otherwise expressly stated, all numerical values in this description that refer either to amounts of material or to conditions of reaction and/or use, are to be understood as modified by the word "about", in describing the broad scope of the invention. However, practice of the invention within the stated numerical vales or ranges is generally preferred.

Also, unless expressly stated to the contrary: percent, "parts of", and ratio values are by weight. Temperatures should be understood to be degrees Fahrenheit unless stated to be otherwise. The description of a group or class of materials as suitable for use in the practice of the invention or as prefer for a given purpose in connection with the invention, implies that mixtures of any two or more of the members of the group or class are suitable or preferred, as well as any individual member named.

The process of the present invention would be useful for separating any mixture of oil, water and contaminants. However, the process is expected to be useful primarily to purify used lubricating oil.

The Apparatus

Figure 2:
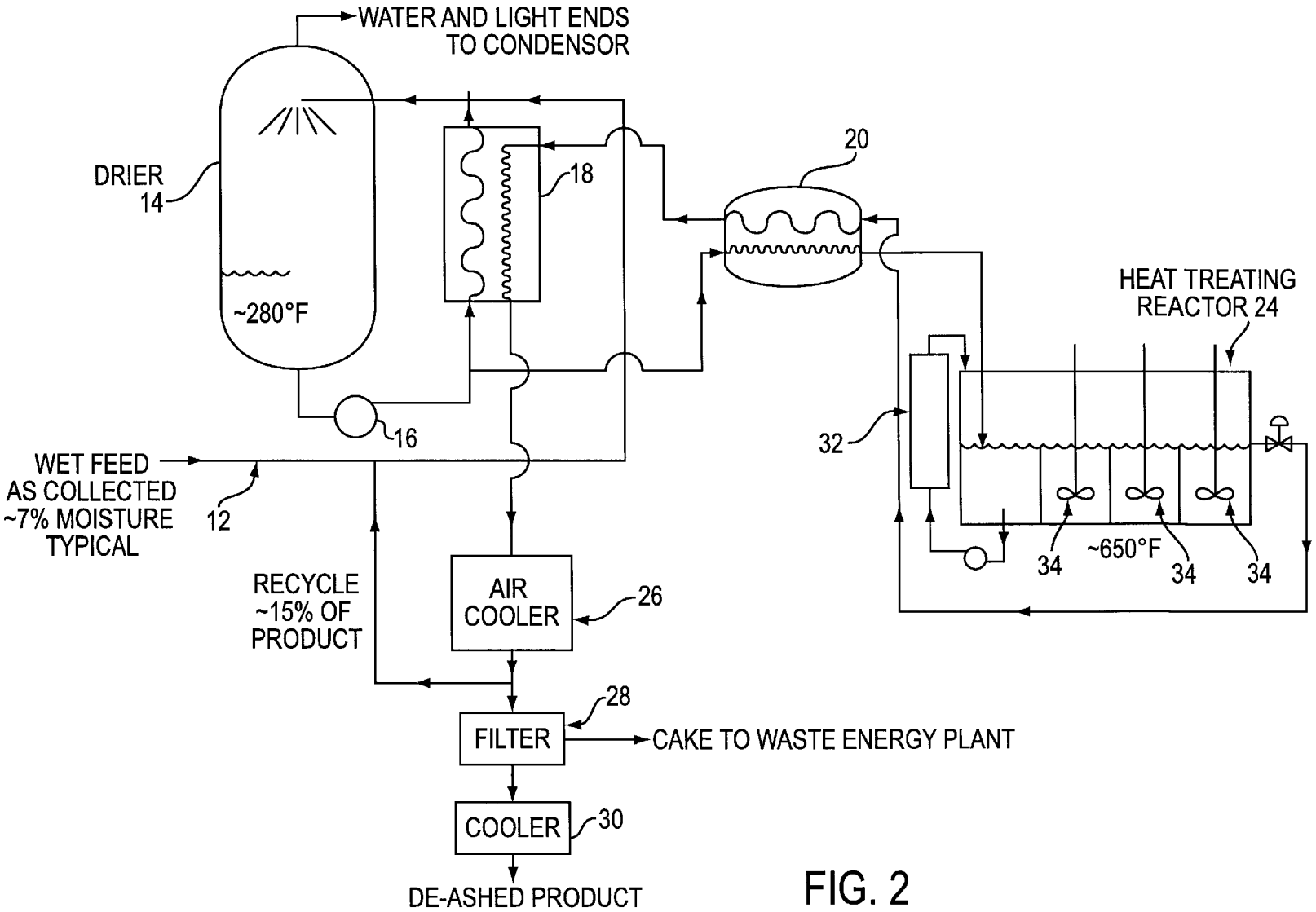
FIG. 2 is a schematic flow diagram in accordance with another embodiment of the process of the invention.

The apparatus that may be used to carry out the process as shown in FIG. 2, includes a supply line 12, a spray dryer 14, a transfer pump 16, a first heat economizer 18, a second heat economizer 20, a heat exchanger 32, a compartmentalized heat-treating and agitating reactor 24, an air cooled heat exchanger 26, a filter 28, mixers 34 and a product cooler 30, together with other auxiliary equipment.

The apparatus that was used in a pilot plant during the development of the process did not include heat economizers. Instead, heating was done by conventional heating devices using steam or THERMINOL as the source of heat.

Figure 1:
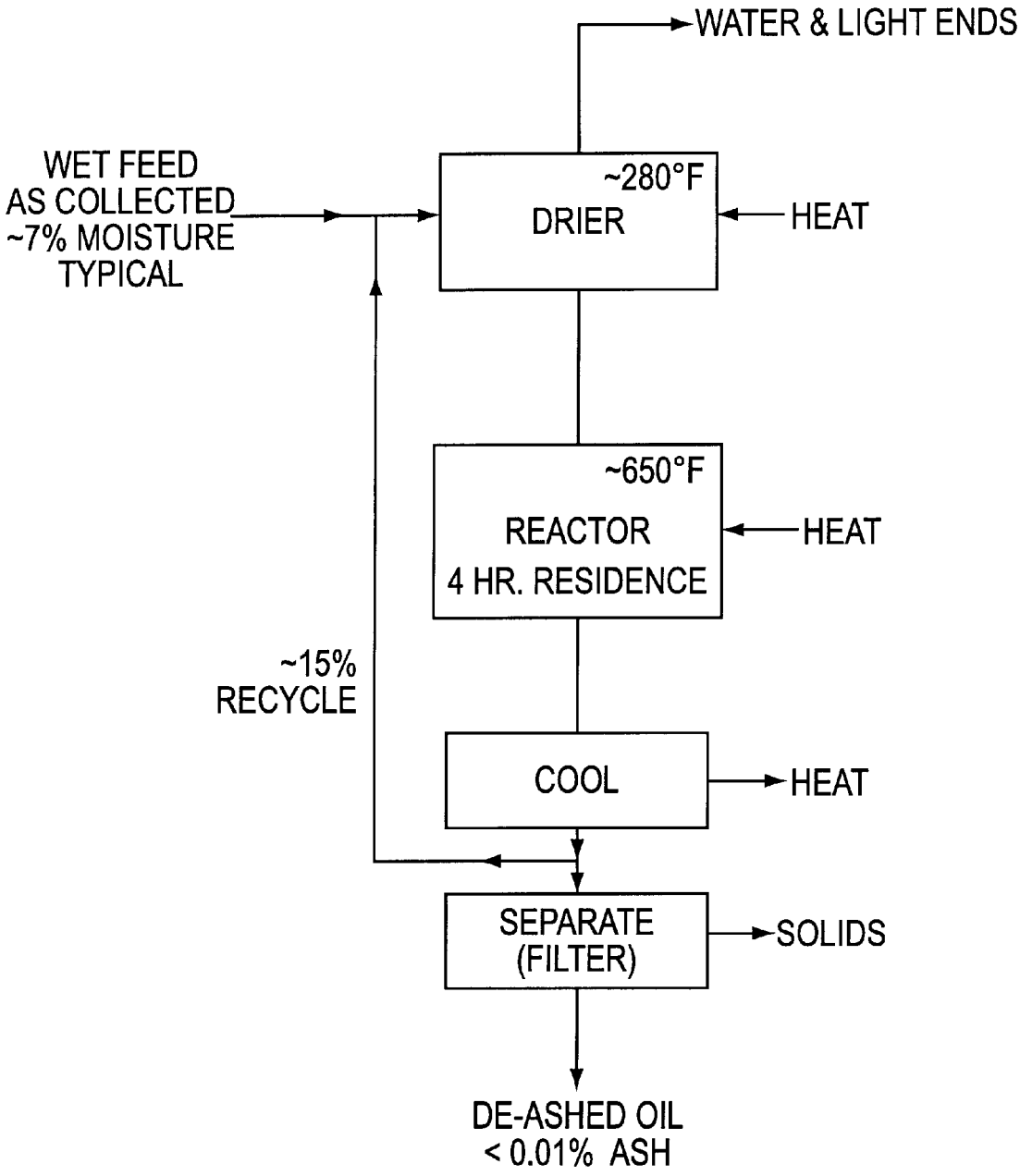
FIG. 1 is a representative schematic flow diagram for the reclamation processing of wet used lubricating oil in accordance with one embodiment of the present invention.

FIG. 1 is a flow diagram showing apparatus that can be used to carry out one process embodiment of the invention. Wet used oil and a recirculating stream of unfiltered product are mixed, then fed into a spray dryer at a temperature at which moisture in the mixture will flash off, such as about 250° F.–300° F. or higher. Dried used oil from the main discharge stream of the dryer is heated to an elevated temperature and then flowed into a compartmentalized heating and agitating reactor where the dried used oil resides at an elevated temperature for an extended period of time. The product from this reactor is then cooled prior to a solids separation step, generally a filtration step. A portion of the stream of cooled unfiltered product is recycled, to mix with the supply stream of wet used oil, and the remaining cooled unfiltered product is passed through a filter or other separator means which removes solids and recovers a filtrate as the product of the invention, which is generally de-ashed oil with an ash content of 0.01% or less.

FIG. 2 is a schematic flow diagram for a different preferred embodiment of the invention. The process is continuous and comprises a drying step, a heat-treating step, a filtration step, and appropriately placed heat economizers which allow heat exchange steps wherein energy is conserved.

In the practice of this embodiment of the process, wet used oil feed is first combined with a recycle of up to about 25% or so of the cooled unfiltered product of a later step, to preferably about 10%–20%, and most preferably about 15%. To the combination is added a recirculating stream of the dried used oil from the spray dryer 14, which recirculating stream had been heated to an elevated temperature, preferably more than 280° F. (137° C.), in a first heat economizer 18. In this way, the mix of wet used oil feed and recycle combine with the recirculating stream to form the drier feed, which is fed into a spray dryer 14 at a temperature that allows moisture in the mix to flash off. The remaining portion of dry used oil from the spray dryer (i.e., the portion which is not recirculated) is heated first in a second heat economizer 20 and then in a heat-treating reactor 24 in which the oil is agitated.

The heat-treating reactor comprises several adjacent heat-treating compartments through which the dried used oil passes. The first treating area is provided with a recirculating means that allows the incoming feed which has been heated to a temperature of about 425° F. or higher to be recirculated through a heat exchanger 32 such as a THERMINOL heat exchanger, so as to maintain a subsequent equilibrium oil temperature in the heat-treating reactor 24 of about 600° F. to about 700° F., preferably 650° F. The heated feed continuously flows from the fist compartment through successive compartments of the heat treating reactor. Each successive compartment is provided with a mixer 34 that constantly slowly agitates the dried used oil, while it is in residence. The residence time in the reactor may be about 1 hour or more, preferably for at least 2 hours, more preferably for at least 3–5 hours, before it is drawn off.

At this point, the heat-treated product is cooled from about 650° F. or more to about 500° F. by flowing it through the second heat economizer. Next the oil is passed through the first economizer, and is subsequently air cooled to a temperature of about 250° F. A portion of the air-cooled, unfiltered, heat-treated oil is recycled to the spray drying step, and the rest of the cooled unfiltered heat-treated oil is filtered. The filtrate is recovered as a dry, very low ash oil ready for use.

OPERATING EXAMPLE

Wet Used Oil And The Wet Oil Mix Which Feeds The Spray Dryer

In the initial operation, wet used lubricating oil was obtained from a used-oil collection point at which used oils from service stations and the like were accumulated. The wet used oil generally had a water content of about 7% and an ash content of about 1%. It is believed that used oils with water contents as low as about 0.1% or higher than 7% can be used, but operations have demonstrated that efficient results can be obtained at moisture contents of 0.1%, 2%, and 7%.

The wet used oil mix that entered into the spray dryer had a temperature of about 280° F. and was a mixture of three components: wet used oil, recycle, and heated, recirculated dry oil. The heated recirculate provided the means whereby the spray dryer feed reached a temperature of about 280° F. The recycle component of the wet used oil mix was a stream of the cooled dried oil that had been treated in the heating and agitating reactor 24.

The mix that was supplied to the spray dryer was prepared as follows. First, used oil feed at room temperature was combined with a 15% recycle of unfiltered oil from the reactor 24, the recycle having been cooled to a temperature of about 250° F., before it was combined with the wet used oil. Then, the mix was heated to a temperature of about 280° F. by mixing with the recirculating stream of hot, dried oil. At this point, the mix entered the spray dryer.

Dried Oil From Spray Dryer

The moisture and some light ends of the oil flashed off from the spray dryer and were condensed and collected. The water layer was removed and the oil layer was reserved and combined with the filtered product, to thereby become part of the final dry, clarified oil product of the invention.

The stream of dried used oil recovered from the spray dryer 14 was passed into the first compartment of the reactor 24 at a temperature of about 280° F. The first compartment of the reactor 24 was equipped with a THERMINOL heat exchanger. The dried oil feed in the fit compartment was continuously recirculated through the THERMINOL heat exchanger. In this way, the oil in the reactor 24 was maintained at a temperature of about 650° F. The oil in the highly agitated first compartment then flowed through small openings in the baffles that separated one successive compartment from another. A mixer 34 in each compartment gently stirred the contents. The oil was in residence in the heat-treating reactor 24 for an average time of about 4 hours.

The oil from the reactor 24 was then passed through a cooler and was thereby cooled to about 250° F. Preferably, in a continuous commercial operation, it would be cooled by passage through the heat exchangers 20, 18, 26. The cooled oil, less the 15% recycle, was then filtered through a polyester filter cloth which had been precoated with a thin layer of diatomaceous earth or other filter aid.

The Filter Cake and the Filtrate

The filter cake was easily separated from the filter cloth of the filter 28. It was suitable for use as fuel for a waste energy plant, providing about 13,000 B.T.U. of heat per pound.

The filtrate was combined with the condensed light ends recovered from the spray drying step to form the reclaimed end product of the process. The end product had an ash content measured of less than 0.01% based on the weight of the oil product.

Recirculating and Recycling

The step of recirculating spray dried used oil is optional. The feed for the spray dryer may be heated in some other way.

The recycling of unfiltered heat-treated oil was necessary, in this initial operation that demonstrated the invention. In the example, a 15% recycle was used. It is contemplated that the amount of recycle can be about 5% or less, or more than 15%, as is economically practical.

Flow Rates

In the operating example, wet feed with about 7% moisture content was flowed into a supply line at the rate of about 1.07 parts/hour. Dried used oil exited the spray drier at a rate of about 1.14 part/hour and was transferred by a supply line to the first compartment of reactor 24. The oil in the first compartment of the reactor 24 was recirculated through the THERMINOL heat exchanger 32 at a rate of about 1200 parts/hour. The oil was subsequently gently agitated to promote agglomeration and particle growth and to allow efficient filtration. These flow rates clearly demonstrate that the oil in the first compartment was highly agitated whereas the oil in the subsequent three zones was relatively quiescent by comparison, even though it was always necessary that the oil be gently agitated therein. After a residence time in the heat-treating reactor 24 of about 4 hours at about 650° F., the heat-treated oil product exited the reactor 24 at a rate of about 1.14 parts/hour. About 15% of the heat-treated product was recycled to the wet feed line for the spray drier.

The assumption has been made in the description of the process of the invention that the process will be carried out at atmospheric pressure. However, it is contemplated that there can be variations in operating conditions of the process, and the process might be carried out at pressures other than atmospheric.

It is also contemplated that in another embodiment of the invention, the separate dryer step could be eliminated and the wet used oil could be fed directly into the first compartment of a heat-treating reactor. In this embodiment, provisions would have to be made in the heat-treating reactor which would allow the flashed off water and the flashed off light ends to escape from the reactor.

While the invention has been described in connection with particular embodiments thereof, it should be understood that the invention is not confined to what has been demonstrated in this application to be useful and the invention is one of broad scope as defined in the appended claims.

What is claimed is:

1. A process for recovering clarified, de-ashed, dried oil from wet used lubricating oil containing undesirable components, comprising the steps of (a) supplying used lubricating oil containing moisture and ash-forming contaminants to a drying zone at a temperature sufficiently high that moisture in said oil flashes off to form a dried oil;

(b) feeding said dried oil to one or more heat treating zones wherein said dried used oil is heated to a temperature of at least about 600° F. with agitation for a retention time within the range from about 2–5 hours to cause solids in said oil to become separable from the oil;

(c) cooling said heat-treated oil to form a cooled oil; and (d) recycling up to 30 wt % of said cooled oil to said one or more heat treating zones and separating solids from the remaining cooled oil to produce a clarified, dried lubricating oil exhibiting an ash content of less than 0.01%.

2. The process of claim 1, wherein said process is continuous.

3. The process of claim 1, wherein the temperature of said drying zone is in the range of from about 250° F. to about 300° F.

4. The process of claim 3, wherein said temperature is about 275° F. to 285° F.

5. The process of claim 1, wherein said used lubricating oil has a moisture content of about 6%–8% by weight.

6. The process of claim 1, wherein the step of separating solids from the cooled oil of step (c) comprises filtering said cooled oil through a filter cloth coated with diatomaceous earth.

7. The process of claim 1 further comprising recirculating a portion of said dried oil for mixture with said used lubricating oil fed into said driving zone.

8. The process of claim 1 further comprising recirculating a portion of said cooled oil for mixture with said used lubricating oil fed into said drying zone.

9. A process for recovering clarified, de-ashed, dried oil from wet used lubricating oil that contains undesirable components, comprising the steps of (a) injecting a supply of wet used lubricating oil comprising (i) wet used oil, (ii) up to 30% of a recycle portion of the cooled oil from step (f) below, and (iii) a recirculating portion of dried used oil from step (a), into a drying zone, said recirculating portion (iii) being in sufficient quantity and at a sufficiently high temperature that moisture in said supply of used oil feed flashes off in said drying zone and dried used oil is withdrawn from said drying zone; then (b) heating the said dried oil to a temperature of at least 650° F.; then (c) transferring said heated used oil to a heat treating and agitating zone;

(d) agitating and flowing said heated dried used oil into successive areas of said heat-treating zone for a residence time within the range of 1–5 hours to permit solid particles to become more readily separable from said oil upon filtration;

(e) removing the heat-treated oil from said heat-treating zone;

(f) cooling the heat-treated oil of step (e) to about 240° F. to about 280° F. to form a cooled oil;

(g) separating up to about 30 wt % of said cooled oil for recycle to a heating zone;

(h) separating the solids from the remaining product of step (f) to produce a clarified, de-ashed dried oil, and (i) recovering said clarified, de-ashed dried oil at an ash content of <0.01%.

10. A process in accordance with claim 9, wherein said process is a continuous process.

11. A process in accordance with claim 10, wherein the temperature of said used oil in said drying zone is in the range from about 250° F. to about 300° F.

12. A process in accordance with claim 11, wherein said supply of oil to said drying zone is at a temperature in the range of about 250° F. to 300° F.

13. The process of claim 12, wherein said clarified, de-ashed, dried oil has an ash content of less than 0.001% by weight.

14. The process of claim 13, wherein the step of separating solids from the cooled oil of step (c) comprises filtering said cooled oil through a filter cloth coated with diatomaceous earth.

15. A process for recovering clarified, de-ashed, dried oil from wet used lubricating oil comprising the steps of (a) supplying a heated, wet used lubricating oil that contains undesirable components, said used oil comprising a mixture of said wet used oil and the recycle portion from step (d), below, to a drying zone wherein the temperature of said used oil supplied to said zone is such that moisture flashes off and is withdrawn from said zone;

(b) transferring said dried used oil of step (a) to a heat treating and agitating zone wherein said dried oil is maintained at a temperature of at least about 600° F. and kept in an agitated state;

(c) removing heat-treated oil from said heat-treating and agitating zone and cooling it;

(d) separating up to 50 wt % of said cooled heat-treated oil as a recycle portion;

(e) mixing said recycle portion with wet used lubricating oil to form the used oil supply for step (a) above; and (f) separating solids from the remaining cooled product of step (c) to produce a clarified, de-ashed, dried oil with an ash content of <0.01%.

16. The process of claim 15, wherein the process is continuous.

17. The process of claim 15, wherein the used wet oil in said drying zone is at a temperature in the range of from about 250° F. to about 300° F.

18. The process of claim 17, wherein said used wet oil in said drying zone is at a temperature of about 275° F. to 285° F.

19. The process of claim 15, wherein said recycle portion comprises about 10% to about 30% by weight of said cooled heat-treated oil.

20. The process of claim 19, wherein said wet used lubricating oil has a moisture content of about 5%–10% by weight.

21. A process for recovering clarified, de-ashed, dried oil from wet used lubricating oil containing undesirable components, comprising the steps of (a) supplying a used wet lubricating oil to the first of one or more heat-treating areas wherein the temperature in said first area is such that moisture in said wet used oil flashes off in said first area;

(b) heating the remaining dried oil to an elevated temperature of at least about 650° F. with agitation;

(c) agitating and flowing said heated dried used oil into successive areas of said heat-treating zone for a residence time sufficient to permit solid particles to become more readily separable from said oil;

(d) removing the heat-treated oil from said heat-treating zone;

(e) cooling the heat-treated oil of step (d) to about 240° F. to about 280° F. to form a cooled oil;

(f) separating the cooled oil into a recycle portion of up to about 50 wt % and a remaining portion;

(g) passing said recycle portion into admixture with said used wet lubricating oil supplied to step (a);

(f) filtering said remaining portion through a filter cloth coating with diatomaceous earth; and (g) recovering a clarified, de-ashed, dried oil filtrate with an ash content of <0.01%.

* * * * *